US007617688B2

(12) United States Patent
Biebel et al.

(10) Patent No.: US 7,617,688 B2
(45) Date of Patent: Nov. 17, 2009

(54) COMBUSTION CHAMBER OF A GAS TURBINE ENGINE WITH AN UPSTREAM FAIRING FOR SEPARATING THE GAS STREAM, ANNULAR WALL FORMING A CAP OF THE UPSTREAM FAIRING OF THE CHAMBER, AND GAS TURBINE ENGINE WITH THE CHAMBER

(75) Inventors: Romain Biebel, Le Coudray Montceau (FR); Didier Hippolyte Hernandez, Quiers (FR); Denis Gabriel Trahot, Herblay (FR)

(73) Assignee: SNECMA, Paris (FR)

( * ) Notice: Subject to any disclaimer, the term of this patent is extended or adjusted under 35 U.S.C. 154(b) by 536 days.

(21) Appl. No.: 11/469,693

(22) Filed: Sep. 1, 2006

(65) Prior Publication Data

US 2007/0074520 A1 Apr. 5, 2007

(30) Foreign Application Priority Data

Sep. 23, 2005 (FR) ..... 05 52847

(51) Int. Cl.
*F23R 3/60* (2006.01)

(52) U.S. Cl. ..... 60/796; 60/752

(58) Field of Classification Search ..... 60/752, 60/796, 798, 800, 804
See application file for complete search history.

(56) References Cited

U.S. PATENT DOCUMENTS 6,449,952 B1 * 9/2002 Emilianowicz et al. ..... 60/772

FOREIGN PATENT DOCUMENTS

| | | |
|---|---|---|
| EP | 0 564 171 A1 | 10/1993 |
| EP | 1 251 312 A2 | 10/2002 |
| EP | 1 265 031 A1 | 12/2002 |
| EP | 1 398 571 A2 | 3/2004 |

* cited by examiner

*Primary Examiner*—Louis J Casaregola
(74) *Attorney, Agent, or Firm*—Oblon, Spivak, McClelland, Maier & Neustadt, L.L.P.

(57) ABSTRACT

The present invention is concerned with an annular combustion chamber of a gas turbine engine with an external annular wall and an internal annular wall, including an upstream fairing for separating the gas stream at the inlet of the chamber into a combustion stream and a bypass stream which bypasses the inlet of the chamber, the fairing including an annular wall forming a cap, which includes a downstream portion for fastening to a wall of the chamber and an upstream portion forming an edge of the flow cross section for the combustion stream, wherein the upstream portion is continued into at least one additional downstream portion for fastening to the wall of the chamber.

10 Claims, 3 Drawing Sheets

COMBUSTION CHAMBER OF A GAS TURBINE ENGINE WITH AN UPSTREAM FAIRING FOR SEPARATING THE GAS STREAM, ANNULAR WALL FORMING A CAP OF THE UPSTREAM FAIRING OF THE CHAMBER, AND GAS TURBINE ENGINE WITH THE CHAMBER

BACKGROUND OF THE INVENTION AND DESCRIPTION OF THE PRIOR ART

The invention relates to a combustion chamber of a gas turbine engine with an upstream fairing for separating the gas stream, to an annular wall forming a cap of the upstream fairing of the chamber, and to a gas turbine engine with the chamber.

A turbojet comprises, from upstream to downstream in the direction of gas flow, a fan, one or more compressor stages, a combustion chamber, one or more turbine stages and a gas exhaust nozzle. The terms "external" and "internal" are intended to mean radially external and internal with respect to the axis of the turbojet. The terms "outer" and "inner" are intended to mean the outer side and the inner side of the combustion chamber.

With reference to FIG. 1, which represents a combustion chamber 1 of the prior art, the combustion chamber 1 is generally annular around the axis of the turbojet. It comprises, in its upstream portion, a chamber end section 2 with injection systems supplied with fuel by injectors 3 connected to a supply line 4. The injection systems are distributed along the chamber end section 2. The gas of the primary stream emerges upstream of the chamber 1 via a diffuser 5, from which the gas stream is separated into a stream 6 passing into the combustion chamber 1 to allow combustion of the fuel injected by the injector 3, referred to as combustion stream 6, into an external bypass stream 7 which externally bypasses the inlet of the chamber 1, and into an internal bypass stream 8 which internally bypasses the inlet of the chamber 1. The streams 7, 8 which bypass the inlet of the chamber are used for cooling the chamber 1, in particular.

The primary gas stream is separated at a fairing 9. This fairing 9 comprises two parts, called an external cap 10 and an internal cap 11. The external cap 10 takes the form of an annular metal sheet domed toward the upstream side, fastened to the combustion chamber 1 at an outer downstream surface portion 15, and the inner upstream edge 12 of which forms a fold in the downstream direction, thus forming an aerodynamic surface for separation into an external bypass stream 7 and a combustion stream 6. Likewise, the internal cap 11 takes the form of an annular metal sheet domed toward the upstream side, fastened to the combustion chamber 1 at an outer downstream surface portion 16, and the inner upstream edge 13 of which forms a fold in the downstream direction, forming an aerodynamic surface for separating the internal bypass stream 8 and the combustion stream 6.

The external 10 and internal 11 caps are fastened on the outer side of the external 31 and internal 32 wall, respectively, of the combustion chamber 1, at their outer downstream surface portion 15, 16, respectively, by bolts 14. The external 10 and internal 11 caps are therefore mounted in cantilever fashion on the combustion chamber 1.

The combustion chamber is subjected to vibrational stresses, particularly as a result of the combustion and the engine speed. The caps 10, 11 are therefore subjected to these vibrations, in particular the external cap 10. The caps 10, 11 are also subjected to other dynamic excitation frequencies, in particular certain harmonic frequencies of the rotational speed of the rotating elements of the turbojet. The caps 10, 11, mounted in cantilever fashion, may have resonance modes close to the aforementioned frequencies and are therefore subjected to high mechanical dynamic stresses. The caps 10, 11 are consequently exposed to the risks of breaking or cracking.

Various solutions to this problem have been proposed.

A first solution involves providing an annular damping ring, housed in the fold 12, 13 of the caps 10, 11 (or only in the fold of the external cap which is most subjected to the vibrational stresses); the fold 12, 13 is to this end wrapped around the ring so as to hold it in place. The friction caused by the presence of the ring provides an effect of damping and therefore of shifting the frequencies of the resonance modes of the caps 10, 11, which enables them to be distanced from the vibrational frequencies to which the caps 10, 11 are subjected. However, such a device has the disadvantage of low mechanical strength. There is a risk of the ring loosening, or even breaking (on account of the vibrations to which it is subjected), which diminishes or cancels out its effectiveness.

A second solution involves providing an integrated fairing 9, which will thus be termed a covering. The external 10 and internal 11 caps are then formed in a single piece, with connection tabs between them at their inner upstream edges 12, 13. Such a device has two disadvantages. First, given the connecting tabs between the caps 10, 11, the flow cross section for the combustion stream 6 is reduced; now it is an established fact that this cross section must be as large as possible so as to promote the flow of this stream in order to achieve better combustion efficiency. Second, it is appropriate for the cutouts between the tabs to be formed by laser cutting, these cutouts having to have the equivalent of the folds 12, 13 around their contour. Producing such an integrated covering is very difficult and therefore expensive.

SUMMARY OF THE INVENTION

The invention aims to overcome these disadvantages and to provide a fairing sufficiently withstanding the vibrational stresses, complying with the aerodynamic criteria of stream separation and at the same time having a maximum cross section for the flow of the combustion stream 6, and being able to be produced simply and at low cost.

To this end, the invention relates to an annular combustion chamber of a gas turbine engine with an external annular wall and an internal annular wall, comprising an upstream fairing for separating the gas stream at the inlet of the chamber into a combustion stream and a bypass stream which bypasses the inlet of the chamber, the fairing comprising an annular wall forming a cap, which comprises a downstream portion for fastening to a wall of the chamber and an upstream portion forming an edge of the flow cross section for the combustion stream, wherein the upstream portion is continued into at least one additional downstream portion for fastening to the wall of the chamber.

By virtue of the invention, the cap-forming annular wall, which is fastened not only at its downstream fastening portion but also at the additional downstream fastening portion integral with its upstream portion, is stiffened, which increases the frequency of its resonance modes, which do not intersect with the vibration frequencies to which the flange is subjected. The cantilever effect is attenuated. Moreover, such a cap is mechanically solid, which avoids the disadvantages associated with the presence of a ring, while it allows the fairing for separating the air stream upstream of the chamber to be formed as an external cap and an internal cap, thereby providing an optimum flow cross section for the combustion stream.

Preferably, the downstream fastening portion of the cap is fastened on the outer side of the wall of the chamber and the additional downstream fastening portion of the cap is fastened on the inner side of the wall of the chamber.

Advantageously in this case, with the combustion chamber comprising a chamber end section, the additional downstream fastening portion is fastened to a flange of the chamber end section, which flange is fastened to the wall of the chamber on its inner side.

Preferably again, the downstream fastening portion of the cap, the combustion chamber and the additional downstream fastening portion of the cap are fastened by fastening bolts.

Advantageously in this case, the flange of the chamber end section is also fastened by the fastening bolts.

According to a first embodiment, the additional downstream fastening portion comprises a downstream wall with a downstream portion for fastening to the wall of the chamber.

In a particular embodiment, this downstream wall has cutouts.

According to a second embodiment, the additional downstream fastening portion comprises fastening tabs, extending from the upstream edge, comprising a downstream portion for fastening to the wall of the chamber.

According to a third embodiment, the additional downstream fastening portion comprises reinforcing tabs connected by a downstream rim which supports tabs for fastening to the wall of the chamber.

The invention also relates to an annular wall forming a cap of the upstream fairing of the combustion chamber presented above.

The invention further relates to a gas turbine engine comprising the combustion chamber presented above.

Preferably, the annular wall forming the external cap of the upstream fairing of the combustion chamber is the one according to the invention, because it is this wall which is most subjected to the vibrational stresses. The invention also applies to the internal cap.

The invention is here described in relation to a turbojet, but it goes without saying that it applies to any gas turbine engine comprising a combustion chamber.

BRIEF DESCRIPTION OF THE DRAWINGS

The invention will be better understood with the aid of the description which follows of the preferred embodiment of the fairing of the invention, with reference to the appended plates, in which.

DESCRIPTION OF THE PREFERRED EMBODIMENTS

In the three embodiments of the fairing 9 described hereinafter, only the annular wall forming the external cap of the fairing 9 of the combustion chamber is in accordance with the invention, the annular wall forming the internal cap being in accordance with the caps of the prior art, since it is the external cap which is most subjected to the vibrational stresses. It goes without saying that provision can also be made for the internal cap to be in accordance with the invention by simply transposing the characteristics of the external cap to the internal cap.

Figure 1:
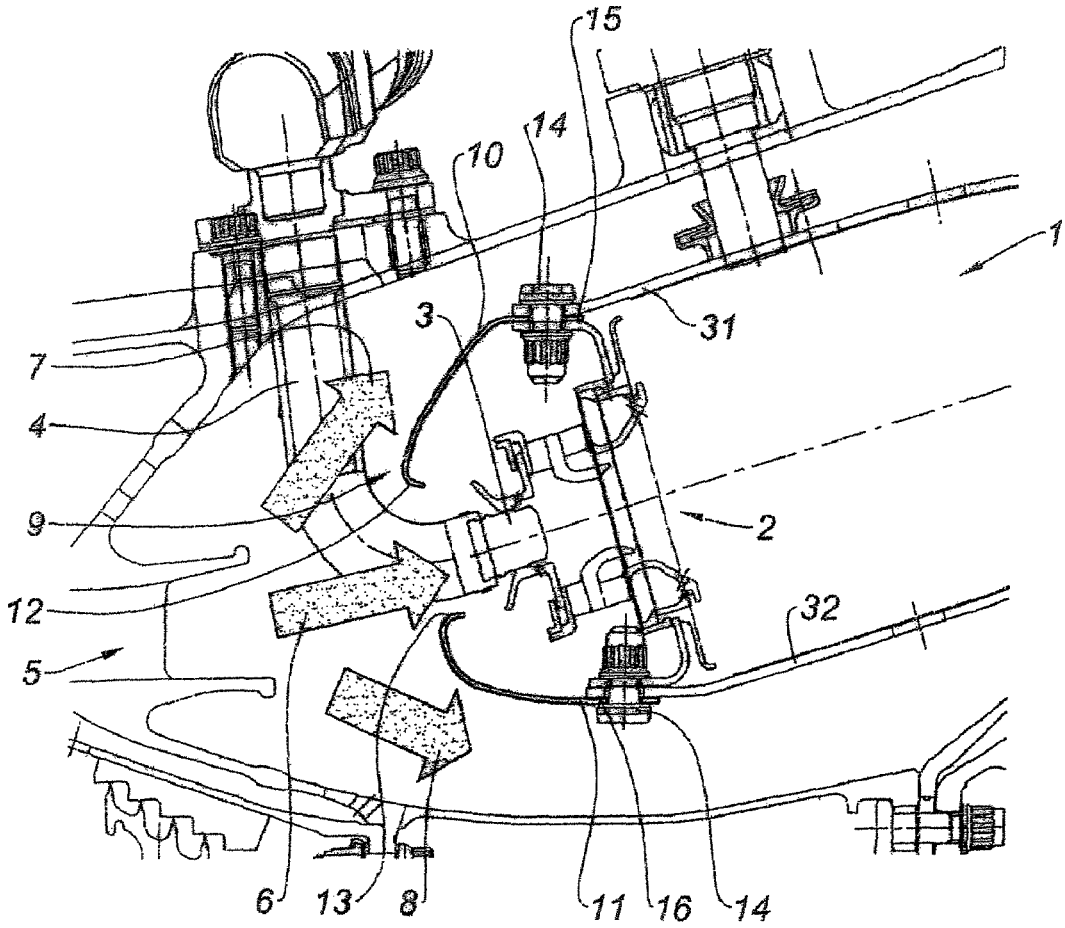
FIG. 1 represents a schematic view in section of a combustion chamber of the prior art.

In the description which follows, the elements of the turbojet which are similar will be denoted by the same references as in FIG. 1. In particular, for the sake of simplification, the upstream fairing 9 of the combustion chamber 1, comprising an external cap and an internal cap, is always denoted by the reference "9". The same applies to the internal cap 11, which is similar to the internal cap 11 of FIG. 1, and to elements which are common to the various embodiments of the external caps.

With reference to FIGS. 2 to 7, and according to the three embodiments described here, the external cap 20, 20', 20" takes the form of a shaped metal sheet of constant thickness (it is thus less expensive and simpler to manufacture). This sheet may be made of any suitable material, for example the same material as the walls of the combustion chamber, in this instance a nickel- or cobalt-based alloy.

The external cap 20, 20', 20" comprises an upstream annular wall 21 for separating the primary gas stream into a combustion steam 6 and a bypass stream 7, an external bypass stream here, which bypasses the inlet of the combustion chamber 1. This upstream wall 21 has a surface similar to that of the caps of the prior art, shaped to allow good separation of the primary gas stream.

On its downstream and outer side, the upstream wall 21 comprises a downstream portion 22 for fastening to the external wall 31 of the combustion chamber 1, on its outer side here. This downstream portion 22 is in this case planar and obtained by folding the sheet metal on the downstream side, in the same way as in the prior art. It comprises holes 23 for the insertion of a bolt (not shown) so that it can be fastened to the external wall 31 of the combustion chamber 1, which comprises corresponding holes 33 for the insertion of the fastening bolts.

On its upstream and inner side, the upstream wall 21 of the external cap 20, 20', 20" comprises an upstream portion 24 folded in the downstream direction, termed upstream edge 24, forming an edge of the flow cross section for the combustion stream 6, in this instance the external edge of this cross section. This downstream portion 24 is continued, on the downstream side, into an additional portion 25 for fastening to a wall of the combustion chamber 1, in this instance the external wall 31, which will be referred to as the additional downstream fastening portion 25.

Figure 2:
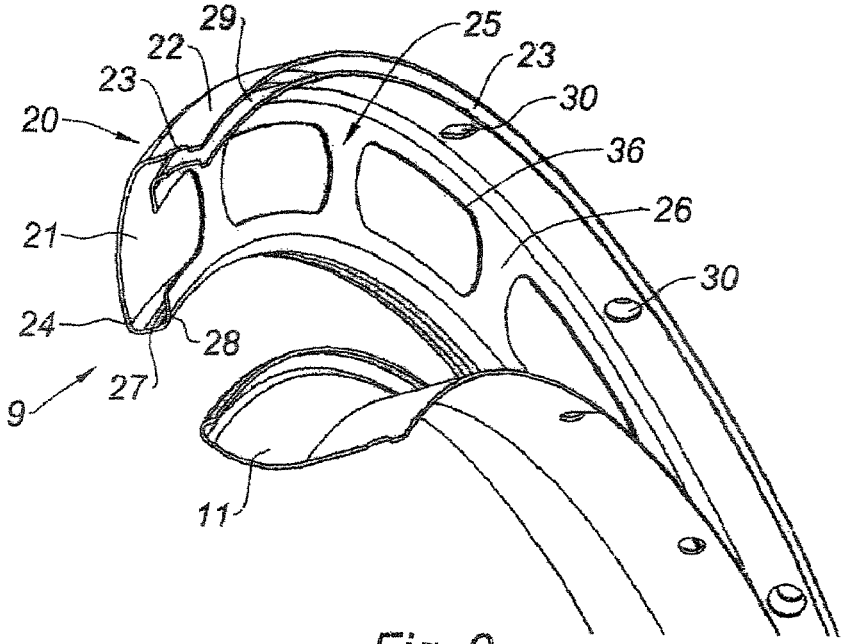
FIG. 2 represents a view in perspective and in partial schematic section of a first embodiment of the fairing of the invention, seen from the downstream direction.
Figure 3:
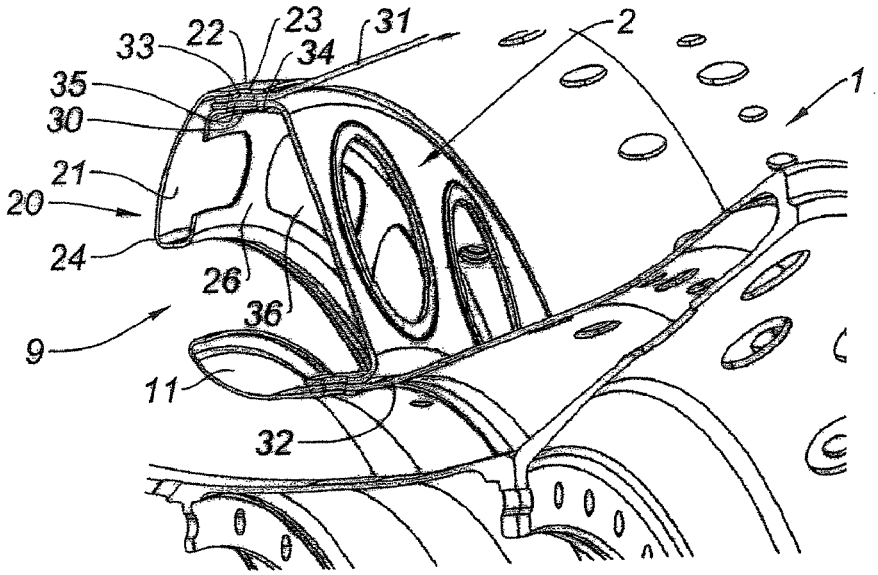
FIG. 3 represents a view in perspective and in partial schematic section of the fairing of FIG. 2, fastened to a combustion chamber, seen from the downstream direction.

In the first embodiment of FIGS. 2 and 3, the additional downstream fastening portion 25 comprises a downstream annular wall 26 which extends downstream from the upstream wall 21. This downstream wall 26 extends from the upstream edge 24, fixedly with the latter, in this instance in a single piece therewith. More precisely, from the upstream edge 24 folded in the downstream direction there extends a planar portion 27 and then a second, outwardly folded edge 28, from which the downstream wall 26 extends outwardly and in the downstream direction, downstream of the upstream wall 21. This downstream wall 26 comprises a planar downstream fastening portion 29 folded in the downstream direction, which is in this case parallel to the downstream fastening portion 22 of the cap 20 fixed to the upstream wall 21 and situated on the inside with respect to this upstream wall. The downstream fastening portion 29 of the downstream wall 26 comprises holes 30 for the insertion of a bolt (not shown) so that it can be fastened to the external wall 31 of the combustion chamber 1, each hole being coaxial with a corresponding hole 23 of the downstream fastening portion 22 of the upstream wall 21.

With reference to FIG. 3, the downstream fastening portion 29 of the downstream wall 26 is fastened to the external wall 31 of the combustion chamber 1, on its inner side. More precisely, it is fastened to a flange 34 of the chamber end section 2, on its inner side, which flange is itself fastened directly to the inner surface of the external wall 31 of the combustion chamber 1. This flange 34 comprises corresponding holes 35 for the insertion of the fastening bolts. Each fastening bolt passes through from the outside to the inside and therefore plays a part in fastening the downstream fastening portion 22 of the upstream wall 21 of the cap 20, the external wall 31 of the combustion chamber 1, the flange 34 of the chamber end section 2, and the downstream fastening portion 29 of the downstream wall 26 of the cap 20.

The external cap 20 is intended to be fastened here, on the one hand, on the outer side of the external wall 31 of the combustion chamber 1, as regards the downstream fastening portion 22 of the upstream wall 21, and, on the other hand, on the inner side of the external wall 31 of the combustion chamber 1, as regards the downstream fastening portion 29 of the downstream wall 26. It goes without saying that any other arrangement can be contemplated in which the external cap 20 is fastened to the external wall 31 of the chamber 1, on the one hand, at the downstream fastening portion 22 of its upstream wall 21, and, on the other hand, at its additional downstream fastening portion 25 continuing its upstream edge 24. It is in particular not necessary for the fastening of these parts also to participate in the fastening of the flange 34 of the chamber end section 2. Fastening is performed here by means of bolts, but any other fastening method may be contemplated, for example by welding, riveting, etc.

In the specific case in question, the downstream wall 26 has cutouts 36 distributed along its circumference so as to reduce its mass. However, the downstream wall 26 may also be solid. In this case, the rigidity and mechanical strength of the external cap 20 are increased, while in the event of a foreign body being ingested and striking the upstream wall 21 and causing a fracture there, the downstream wall 26 can act as a safety wall.

By virtue of the additional downstream fastening portion 25 of the external cap 20, fastened to the external wall 31 of the chamber 1, the rigidity of the external cap 20 is increased, which involves shifting the frequency values of its resonance modes, which are thus distanced from the vibrational frequencies to which the external cap 20 is subjected. The external cap 20 is therefore subjected to smaller vibrational forces and moreover has greater overall strength. Its dynamic response is greater. The cantilever effects are attenuated. The aerodynamic function of separating the primary gas stream is also preserved, since the surface encountered by this stream—the upstream surface of the upstream wall 21—is the same as for the external caps 20 of the prior art. The fairing 9 is, moreover, formed by two caps 20, 11, which allows an optimum flow cross section for the combustion stream 6.

Figure 4:
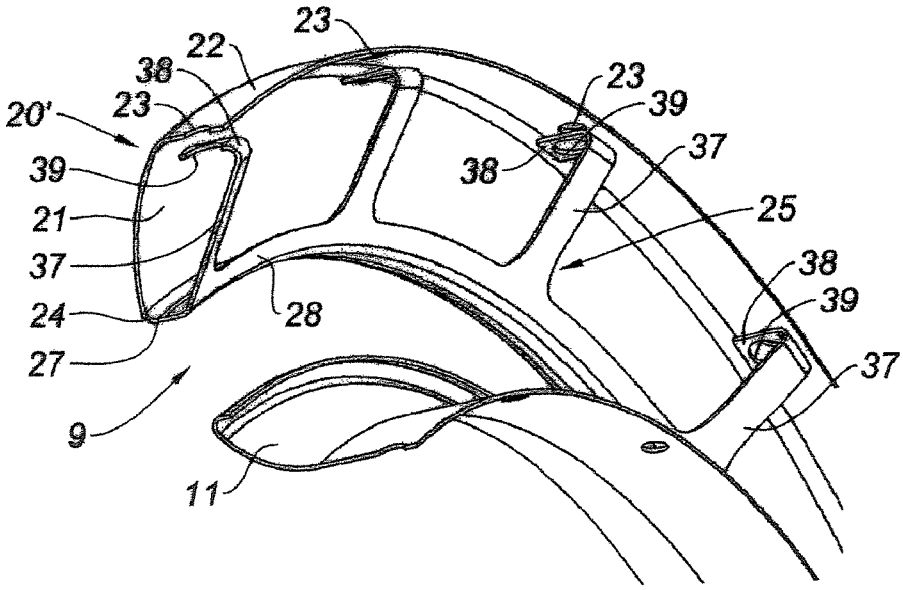
FIG. 4 represents a view in perspective and in partial schematic section of a second embodiment of the fairing of the invention, seen from the downstream direction.
Figure 5:
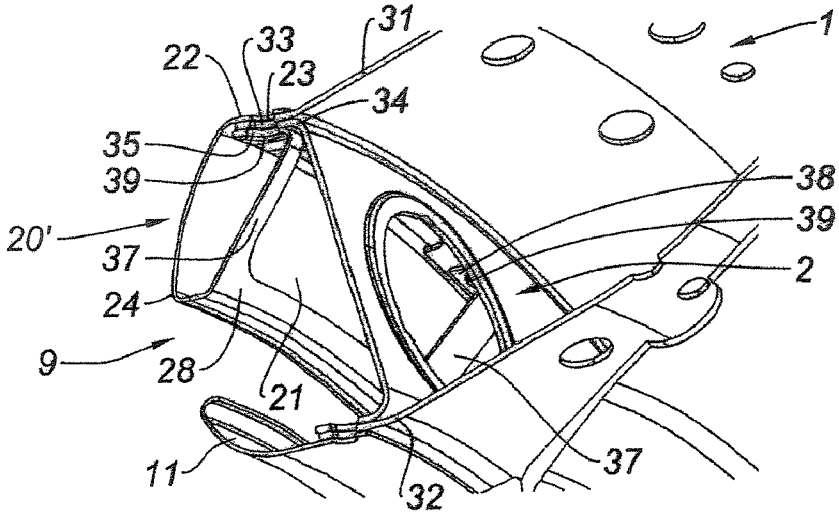
FIG. 5 represents a view in perspective and in partial schematic section of the fairing of FIG. 4, fastened to a combustion chamber, seen from the downstream direction.

In the second embodiment of FIGS. 4 and 5, the additional downstream fastening portion 25 comprises a plurality of fastening tabs 37, also forming reinforcements, which extend from the upstream edge 24 of the external cap 20', fixedly with the latter, in this instance in a single piece therewith. More precisely, from the upstream edge 24 folded in the downstream direction there extends a planar portion 27 and then a second edge 28 folded symmetrically to the upstream edge 24, from which the tabs 37 extend outwardly and in the downstream direction, downstream of the upstream wall 21 of the external cap 20'.

The tabs 37 are uniformly angularly distributed along the circumference of the second edge 28, or downstream inner edge 28, in line with the holes 23 in the downstream fastening portion 22 of the external cap 20' fixed to its upstream wall 21. Each fastening tab 37 comprises a planar downstream fastening portion 38 folded in the upstream direction, which in this case is parallel to the downstream fastening portion 22 of the upstream wall 21 of the cap 20' and situated on the inside with respect to this upstream wall. The downstream fastening wall 38 of each fastening tab 37 comprises a hole 39 for the insertion of a bolt (not shown) so that the tab 37 can be fastened to the external wall 31 of the combustion chamber 1, this hole being coaxial with a corresponding hole 23 in the downstream fastening portion 22 of the upstream wall 21.

With reference to FIG. 5, the fastening tabs 37 are fastened, at their downstream fastening portion 38, to the external wall 31 of the combustion chamber 1, on its inner side. More precisely, they are fastened to the flange 34 of the chamber end section 2, on its inner side, which flange is itself fastened directly to the inner surface of the external wall 31 of the combustion chamber 1. This flange 34 comprises corresponding holes 35 for the insertion of the fastening bolts. Each fastening bolt passes through from the outside to the inside and therefore plays a part in fastening the downstream fastening portion 22 of the upstream wall 21 of the cap 20', the external wall 31 of the combustion chamber 1, the flange 34 of the chamber end section 2, and the downstream fastening portion 38 of the fastening tabs 37 of the cap 20'.

The external cap 20' is intended to be fastened here, on the one hand, on the outer side of the external wall 31 of the combustion chamber 1, as regards the downstream fastening portion 22 of the upstream wall 21, and, on the other hand, on the inner side of the external wall 31 of the combustion chamber 1, as regards the downstream fastening portion 38 of the fastening tabs 37. It goes without saying that any other arrangement can be contemplated in which the external cap 20' is fastened to the external wall 31 of the chamber 1, on the one hand, at the downstream fastening portion 22 of its upstream wall 21, and, on the other hand, at its additional downstream fastening portion 25 continuing its upstream edge 24. It is in particular not necessary for the fastening of these parts also to participate in the fastening of the flange 34 of the chamber end section 2. Fastening is performed here by means of bolts, but any other fastening method can be contemplated, for example by welding, riveting, etc.

Again, by virtue of the additional downstream fastening portion 25 of the external cap 20', fastened to the external wall 31 of the chamber 1, the rigidity of the external cap 20' is increased and the cap 20' is less subjected to the vibrational stresses. Moreover, it has greater strength and its dynamic response is greater. The cantilever effects are attenuated. The aerodynamic function of separating the primary gas stream is also preserved, with an optimum flow cross section for the combustion stream 6. It will be noted that the discrete distribution of the fastening tabs 37 makes it possible for the external cap 201 to be fitted more simply by comparison with the first embodiment in which the downstream fastening portion 29 is continuous. However, the rigidity of the additional downstream fastening portion 25 is less than in the first embodiment.

Figure 6:
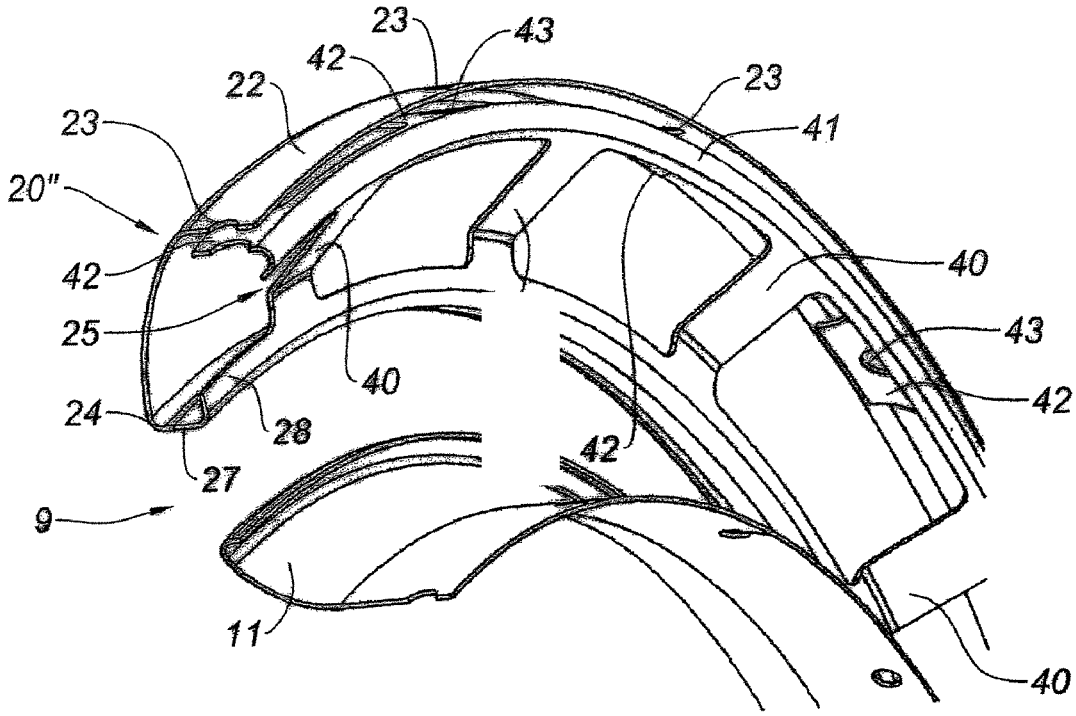
FIG. 6 represents a view in perspective and in partial schematic section of a third embodiment of the fairing of the invention, seen from the downstream direction.
Figure 7:
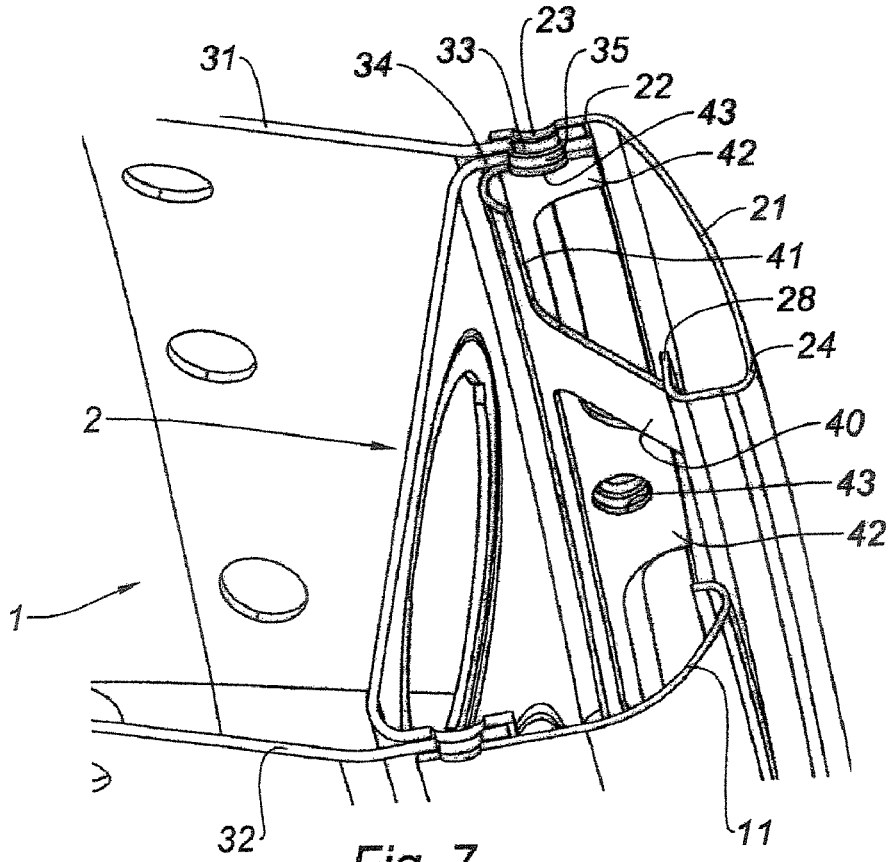
FIG. 7 represents a view in perspective and in partial schematic section of the fairing of FIG. 6, fastened to a combustion chamber and seen from the upstream direction.

In the third embodiment of FIGS. 6 and 7, the additional downstream fastening portion 25 comprises a plurality of tabs 40, forming reinforcements, which extend from the upstream edge 24 of the external cap 20", fixedly with the latter, in this instance in a single piece therewith, these tabs being interconnected at their downstream outer end by an annular rim 41 bearing a plurality of fastening tabs 42, or scallops, extending in the upstream direction. More precisely, from the upstream edge 24 folded in the downstream direction there extends a planar portion 27 and then a second edge 28 folded symmetrically to the upstream edge 24, from which the tabs 40 extend outwardly and in the downstream direction, downstream of the upstream wall 21 of the external cap 20". At their downstream end, the tabs 40 bear, and are connected by, an annular rim 41 folded in the upstream direction. This annular rim 41 bears the plurality of fastening tabs 42, which are planar and extend in the upstream direction, these tabs in this case being parallel to the downstream fastening portion 22 of the upstream wall 21 of the cap 20" and being situated on the inside with respect to this portion.

The reinforcing tabs 40 are uniformly angularly distributed along the circumference of the second edge 28. Each fastening tab 42 is situated angularly between two reinforcing tabs 40, in this instance equidistantly from these reinforcing tabs 40, and is situated in line with a hole 23 in the downstream fastening portion 22 of the upstream wall 21. Each fastening tab 42 comprises a hole 43 for the insertion of a bolt (not shown) so that the tab 42 can be fastened to the external wall 31 of the combustion chamber 1, this hole being coaxial with a corresponding hole 23 in the downstream fastening portion 22 of the upstream wall 21.

With reference to FIG. 7, the fastening tabs 42 are fastened to the external wall 31 of the combustion chamber 1, on its inner side. More precisely, they are fastened to the flange 34 of the chamber end section 2, on its inner side, which flange is itself fastened directly to the inner surface of the external wall 31 of the combustion chamber 1. This flange 34 comprises corresponding holes 35 for the insertion of the fastening bolts. Each fastening bolt passes through from the outside to the inside and therefore plays a part in fastening the downstream fastening portion 22 of the upstream wall 21 of the cap 20", the external wall 31 of the combustion chamber 1, the flange 34 of the chamber end section 2, and the fastening tabs 42 of the cap 20".

The external cap 20" is intended to be fastened here, on the one hand, on the outer side of the external wall 31 of the combustion chamber 1, as regards the downstream fastening portion 22 of the upstream wall 21, and, on the other hand, on the inner side of the external wall 31 of the combustion chamber 1, as regards the fastening tabs 42. It goes without saying that any other arrangement may be contemplated in which the external cap 20" is fastened to the external wall 31 of the chamber 1, on the one hand, at the downstream fastening portion 22 of its upstream wall 21, and, on the other hand, at its additional downstream fastening portion 25 continuing its upstream edge 24. It is in particular not necessary for the fastening of these parts also to participate in the fastening of the flange 34 of the chamber end section 2. Fastening is performed here by means of bolts, but any other fastening method can be contemplated, for example by welding, riveting, etc.

Again, by virtue of the additional downstream fastening portion 25 of the external cap 20", fastened to the external wall 31 of the chamber 1, the rigidity of the external cap 20" is increased and the cap 20" is less subjected to the vibrational stresses. Moreover, it has greater strength and its dynamic response is greater. The cantilever effects are attenuated. The aerodynamic function of separating the primary gas stream is also preserved, with an optimum flow cross section for the combustion stream 6.

It will be noted that this third embodiment is, as it were, intermediate between the first two embodiments, with fastening provided by discretely distributed tabs 42, which facilitates fitting of the cap 20", but with a more rigid structure than in the case of the second embodiment on account of the rim 41 connecting the reinforcing tabs 40. The alternating angular arrangement of the reinforcing tabs 40 and the fastening tabs 42 affords better distribution of the forces.

It is possible to envision other embodiments in which the external cap comprises a downstream portion 22, fixed to its upstream wall 21, for fastening to the external wall 31 of the combustion chamber 1, and an additional downstream fastening portion 25, fixedly continuing the upstream edge 24 of its upstream wall 21, for fastening to this same external wall 31.

The invention claimed is:

1. An annular combustion chamber of a gas turbine engine with an external annular wall and an internal annular wall, comprising:

an upstream fairing for separating the gas stream at the inlet of the chamber into a combustion stream and a bypass stream which bypasses the inlet of the chamber, the fairing comprising an annular wall forming a cap, said cap comprises an upstream portion forming an upstream edge of a flow cross section for the combustion stream, wherein said cap further comprises a first downstream portion extending on an outer side of said chamber from said upstream portion and configured to fasten to a wall of the chamber, said cap further comprising a second downstream portion extending on an inner side of said chamber from said upstream edge and configured to fasten to a wall of the chamber.

2. The combustion chamber as claimed in claim 1, wherein the second downstream fastening portion is fastened to a flange of a chamber end section, said flange being fastened to the wall of the chamber on its inner side.

3. The combustion chamber as claimed in claim 2, wherein the first downstream portion of the cap, the wall of the combustion chamber and the second downstream fastening portion of the cap are fastened by fastening bolts.

4. The combustion chamber as claimed in claim 3, wherein the flange of the chamber end section is also fastened by the fastening bolts.

5. The combustion chamber as claimed in claim 4, wherein the second downstream portion comprises a downstream annular wall.

6. The combustion chamber as claimed in claim 5, the downstream annular wall has cutouts.

7. The combustion chamber as claimed in claim 4, wherein the second downstream fastening portion comprises fastening tabs, extending from the upstream edge of the cap.

8. The combustion chamber as claimed in claim 4, wherein the second downstream fastening portion comprises reinforcing tabs connected by a downstream rim which supports tabs for fastening to the wall of the chamber.

9. A gas turbine engine comprising the combustion chamber of claim 1.

10. The combustion chamber as claimed in claim 1, wherein the first and second downstream portions are made of a single piece of metal.

* * * * *